US005690134A

United States Patent [19]

McCauley

[11] Patent Number: 5,690,134

[45] Date of Patent: Nov. 25, 1997

[54] PORTABLE SUNSHADE CANOPY

[76] Inventor: William E. McCauley, 2121 Valderas Dr., No. 41, Glendale, Calif. 91208

[21] Appl. No.: 772,973

[22] Filed: Dec. 23, 1996

[51] Int. Cl.[6] ..... E04H 15/44

[52] U.S. Cl. ..... 135/133; 135/114; 135/116; 135/900; 135/148

[58] Field of Search ..... 135/96, 128, 132, 135/133, 134, 136, 137, 148, 147, 115, 900, 902, 116

[56] References Cited

U.S. PATENT DOCUMENTS

| | | | |
|---|---|---|---|
| 1,007,829 | 11/1911 | Westbrook | 135/133 |
| 3,995,649 | 12/1976 | Robichaud | 135/133 |
| 4,506,689 | 3/1985 | Fiddler | 135/133 |
| 4,716,919 | 1/1988 | Griffin | 135/133 |
| 5,320,405 | 6/1994 | Foster et al. . | |
| 5,511,259 | 4/1996 | Tarara . | |

FOREIGN PATENT DOCUMENTS

| | | | |
|---|---|---|---|
| 2402503 | 7/1975 | Germany | 135/132 |
| 3611058 | 10/1987 | Germany | 135/132 |

*Primary Examiner*—Lanna Mai
*Attorney, Agent, or Firm*—George J. Netter

[57] ABSTRACT

A portable sunshade (10) includes semi-hoop elements (16, 18,20) for holding an elongated strip (28) of sun and air moisture impermeable material spaced apart to form an enclosure (44). Elements (18,20) can be pivoted past each other to replace the impermeable materials (28) with a netting piece (45) passing a part of incident sunlight. A strip (38) of soft-to-the-touch material extends over a part of strip (28) providing a body rest portion. A netting sheet (36) is removably located between material (28) and strip (38).

13 Claims, 6 Drawing Sheets

PORTABLE SUNSHADE CANOPY

FIELD OF THE INVENTION

The invention relates generally to a sunshade shelter which is optimally lightweight enhancing portability and is especially advantageous for use pool side, at the beach or on any other acceptable ground base.

DESCRIPTION OF RELATED ART

A variety of sunshade devices are available for use at the beach, for example, such as umbrellas of varying sizes which can either rest on the ground or have the pole portion inserted into the ground to provide a shaded area defined by the overlying canopy section. Also, various kinds of tents or cabanas are known which can be taken to the locale of use and assembled as required. However, other than the hand carried parasol or umbrella which is conveniently utilized when standing or walking, the tent varieties all tend to be either difficult to assemble into a use condition or when packed for transport or storage are relatively large, bulky and cumbersome.

It is therefore a desideratum to provide a sunshade type of shelter which can be readily arranged into a bag-like form for ready hand-carrying transport from a vehicle, for example, to the use location, and which is sufficiently light so that it may be carried by a single individual even when required to walk a relatively long distance. Also, it is desirable that on arriving at the use location, that the sunshade shelter or cabana can be quickly and easily spread out on the ground for providing relief from the sun in an optimally short time (e.g., 1 minute) and not requiring complex assembly and disassembly.

SUMMARY OF THE INVENTION

It is therefore a primary aim and object of the invention to provide in a single package, bag-like form a sun shade apparatus or cabanas including a strap by which it can be readily carried by one individual from one location to another, and which can be assembled for ground base receipt into a shelter to protect against the sun's rays while the user is lying thereon and thereunder.

Another object as in the previous object provides means for selectively converting total shading portions of the apparatus into partially light transmitting means in order to provide the individual using the apparatus partial exposure to the sun's rays as desired or needed.

A still further object, as in the previous objects, is the provision of selective exposure to the sun's rays for just the head and shoulder portions or the entire body.

BRIEF DESCRIPTION OF THE DRAWING

The above described objects and advantages of the present invention will become more readily apparent upon reference to the detailed description that follows with reference to the attached drawings, in which.

DESCRIPTION OF A PREFERRED EMBODIMENT

Figures 1, 2:
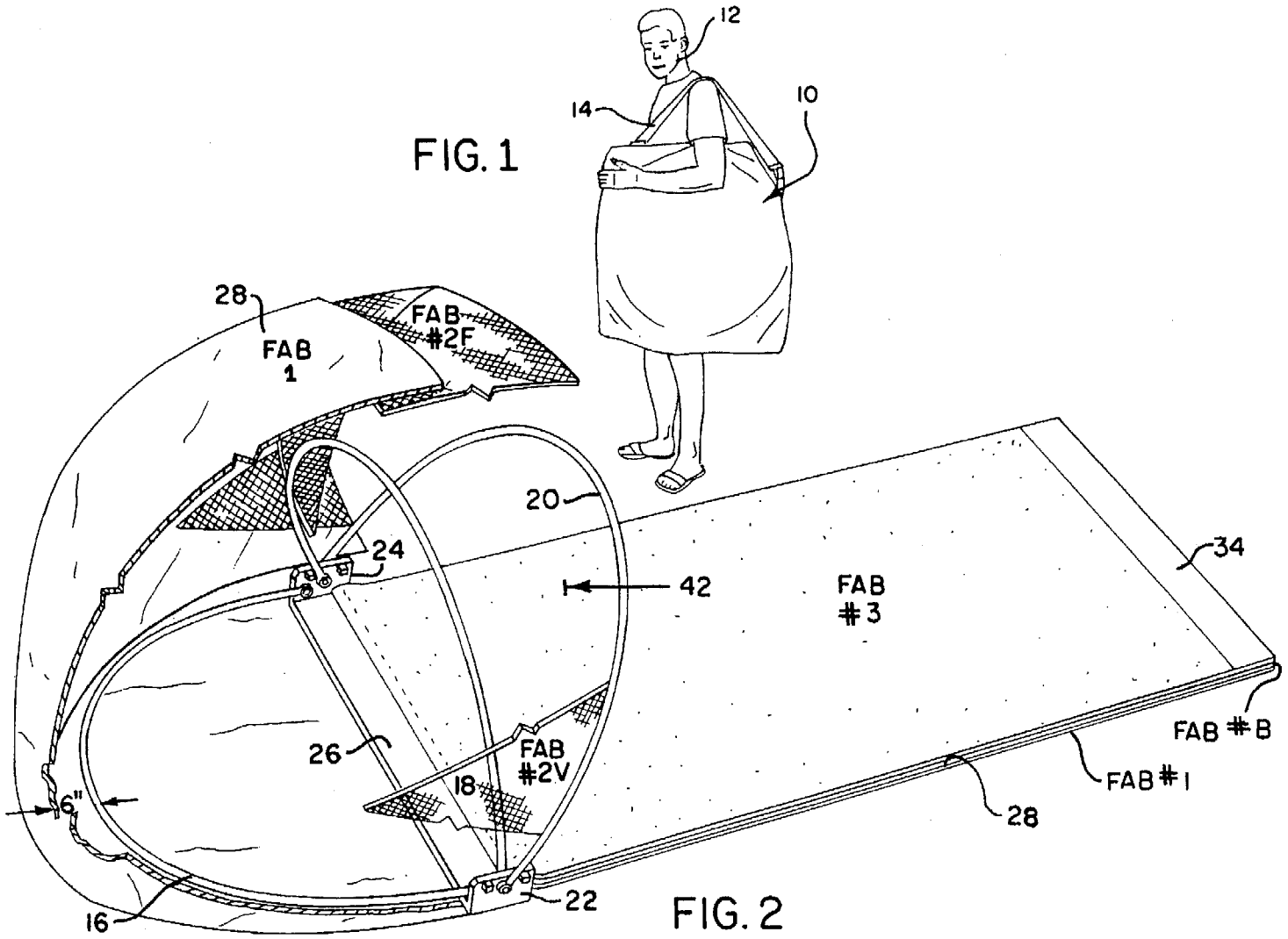
FIG. 1 is a perspective view of the invention shown being carried by an individual.
FIG. 2 is a perspective, partially sectional and fragmentary view of the invention.

Turning now to the drawings and particularly FIG. 1 there is shown the sunshade apparatus of the invention enumerated generally as 10 which has the general assembled form of a large bag that can be easily carried on the shoulder of an individual 12 by use of a strap 14. As will be more particularly described, the apparatus 10 is light-weight and wieldy enabling it to be readily carried to and from a site for use, which may be the beach, at poolside, on a lawn, park or any other recreational area where it is desired to relax and where an individual using the apparatus may be exposed to the sun.

Figure 3:
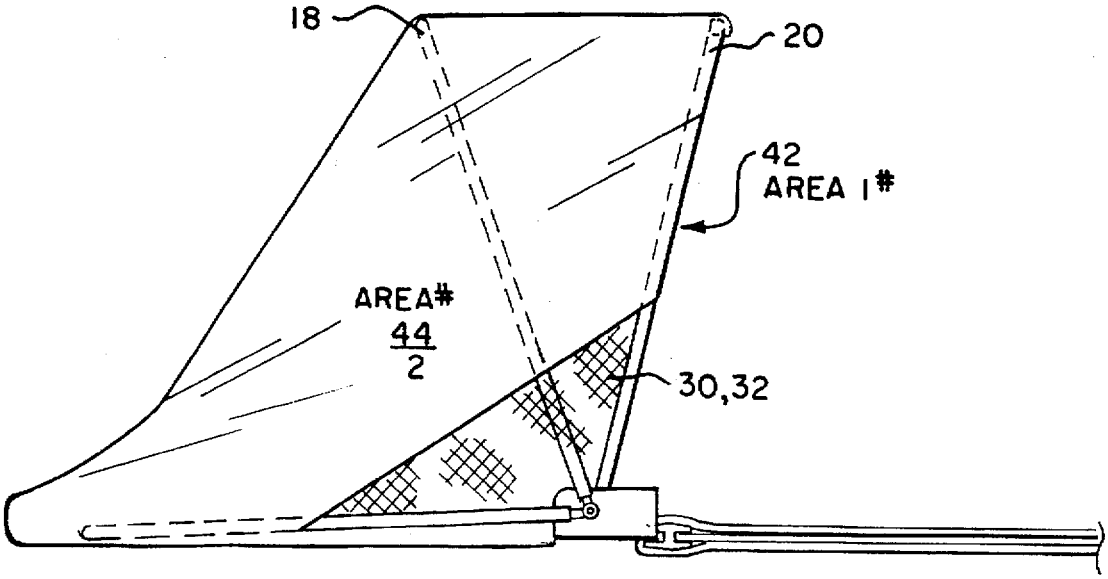
FIG. 3 is a side elevational, partially fragmentary, view showing the apparatus arranged to totally block rays of the sun from impinging on the head and shoulders.
Figure 4:
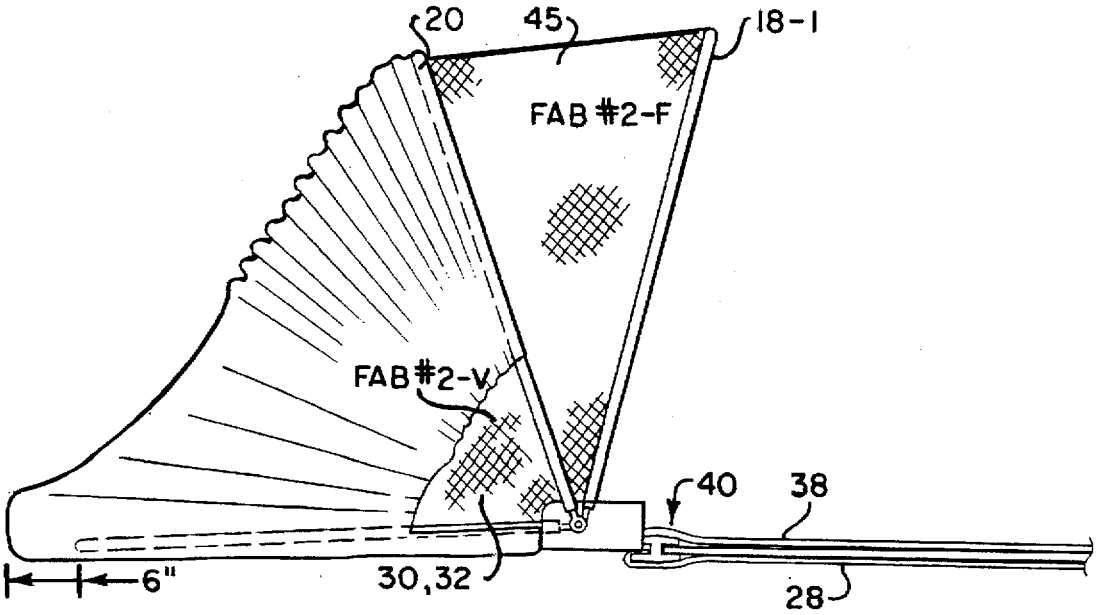
FIG. 4 is a view similar to FIG. 3 except arranged to permit partial exposure of the head and shoulders to the sun.

For the ensuing detailed description of the apparatus 10, reference is now made to FIGS. 2–4. As shown, the framework for the apparatus includes first, second, and third semi-hoop elements 16, 18 and 20, respectively, each of which elements includes an elongated rod of flexible material with the two ends being secured to first and second indexing support plates 22 and 24. The rod material also has sufficient rigidity and springlike characteristics that when so-mounted to the plates, the element intervening portion bows outwardly in an arcuate form. For a purpose to be explained later, the hoop 18 is slightly shorter and, therefore, of lesser outward extension than the element 20 thereby enabling element 18 to be swung through the space defined by element 20, in both directions for a purpose that will be described later.

A generally rectangular elongated mounting base 26 is affixed to and extends between the two indexing plates 22 and 24 holding them at a fixed predetermined spacing. An elongated strip 28 of a generally water and air impermeable material is secured at one end to the front semi-hoop element 20, stretched over the other two elements, and then brought back and forwardly across the mounting base 26 to extend away from the base for a predetermined length (FIG. 2). In particular, the strip 28 has its one end portion affixed about the element 20 (e.g., sewing, adhesive) and also suitably secured to the semi-hoop element 16 in order to provide an angular opening extension between these two elements on the order of 130 degrees. The central semi-hoop element 18 is not secured to the strip 28, and can be moved to various intermediate positions, as desired. The opposed portions of the same lateral edge of the strip are secured to one another by first and second extents 30 and 32 of netting of open weave permitting approximately 50% light to pass therethrough as well as air (FIGS. 2 and 3).

The outermost end of the flexible strip 28 is enumerated generally as 34. The extent of the strip 28 between the base 26 and 34 when stretched out is sufficient to accommodate a human adult body lying on it with the feet positioned just short of the strip material end 34 and the head located approximately midway between the elements 18 and 20

Figure 5:
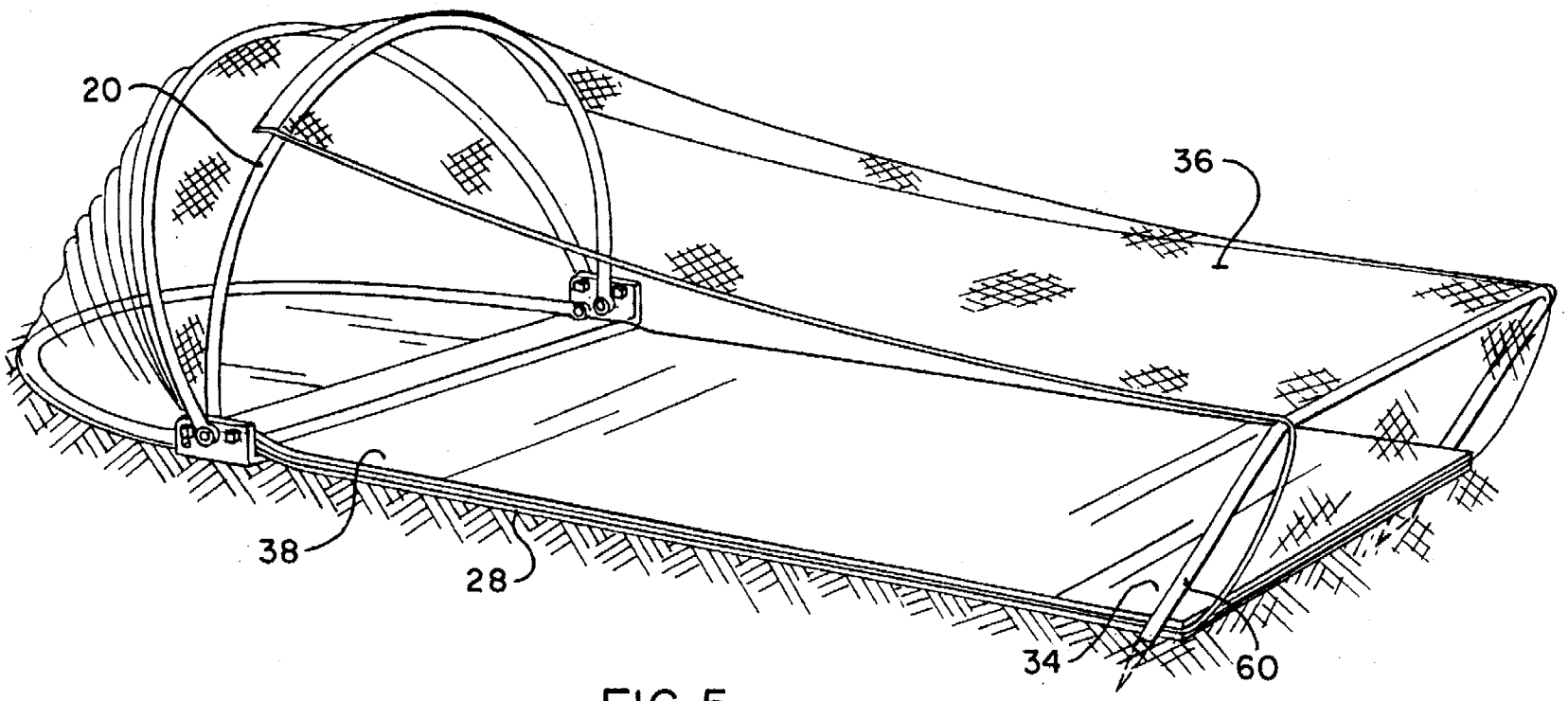
FIG. 5 is a perspective view of the invention shown fully assembled on a ground plane for use.

(FIGS. 2 and 5). It is preferable that the distance between 26 and 34 be about six (6) feet.

Figure 8:
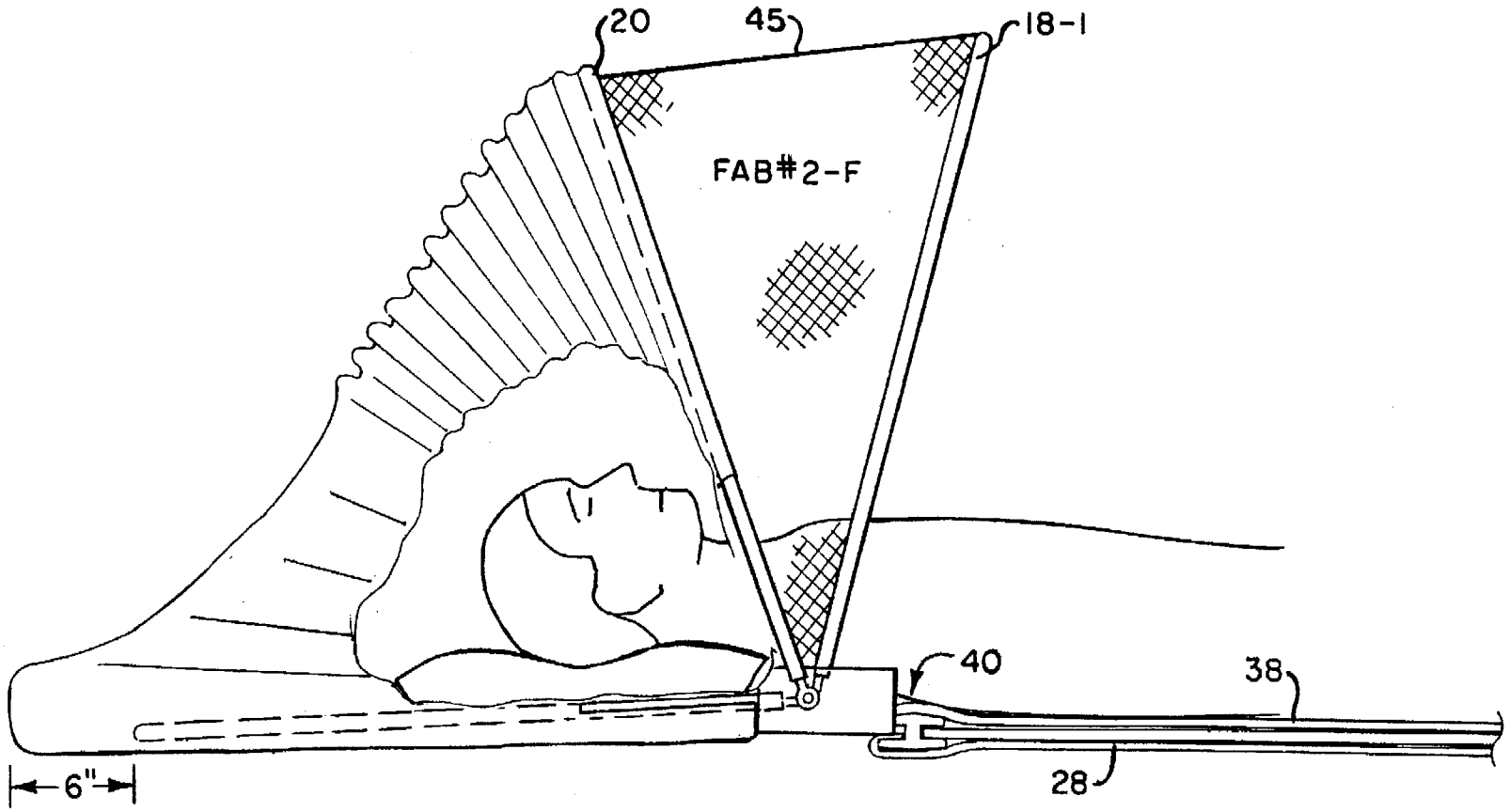
FIG. 8 is an elevational partially fragmentary view of the invention showing partial sun blockage for the head and shoulders.

A sheet of netting material 36 of geometry and dimensions preferably substantially identical to the flexible strip material that extends between the two bases has one end connected to the upper part of the strip material end 34 and in assembled mode lies on the underlying strip 28 in a smooth and unruffled manner. A textile generally soft-to-the touch material sheet 38 (e.g., toweling) of dimensions and geometry preferably the same as the netting sheet 36 has one of its narrow edges affixed to what is the upper surface of the first base 26 at 40 (FIG. 8). The remainder of the textile sheet 38 is free and in use is stretched out over the underlying netting sheet 36 and ground-based portion of the strip 28.

In use of the sunshade apparatus of the invention as described to this point, the outer end portion of the strip 28 in composite arrangement with the netting sheet 36 and textile sheet 38 are spread out on a suitable ground plane in front of the head and shoulders shading arrangement formed by the elements 18 and 20 covered by a portion of the strip 28 (FIGS. 5 and 8). The arching semi-hoop elements 18 and 20 form an entrance opening 42 to the enclosed region 44 shaded by the canopy formed from the strip 28 secured to the semi-hoop elements. The head and perhaps part of the shoulders of someone lying on the textile sheet 38 are received within 44 and shaded accordingly.

In a further aspect of the invention, a segmentally shaped piece of netting 45 is secured to both the center and front semi-hoop elements 18 and 20 so as to extend therebetween in the uppermost part of the arched elements (FIG. 4). In the full-shaded mode shown in FIG. 3 the netting plays no active part and the overlying strip 28 completely blocks the sun passage onto the individual's head and adjacent parts within the enclosure 44. If, however, it is desired to receive some sun on the head and face, but not full strength sun, then element 18 is moved to the forwardmost position and element 20 at the same time is moved to the position formerly held by element 18 (FIGS. 4 and 8). In this arrangement, sunlight in a proportion determined by the particular netting opening size (e.g., 50%) can now make its way to the head and adjacent parts of the torso. To return to the full-shade mode of FIG. 3, the two semi-hoop elements 18 and 20 are merely returned to their original relative positions (FIG. 3).

Figure 6:
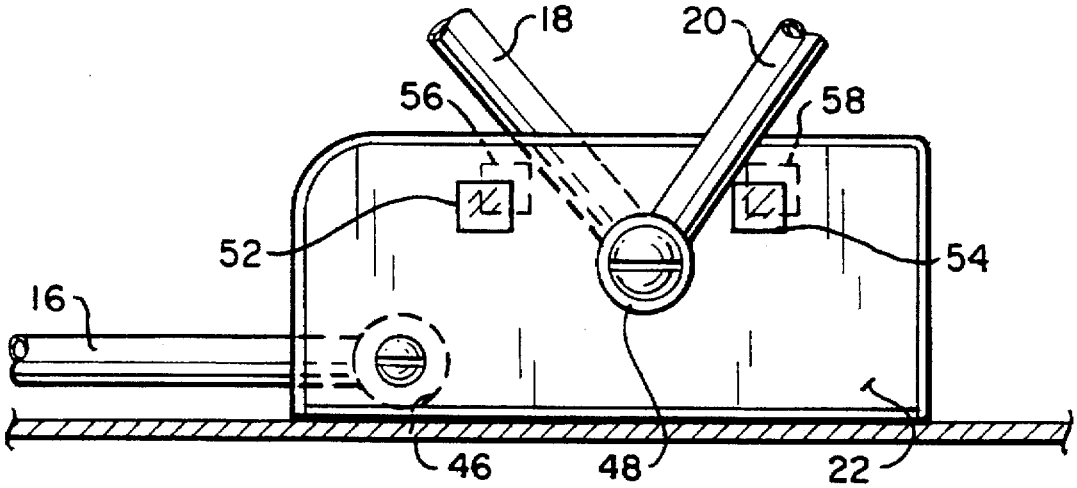
FIGS. 6 and 7 show side elevational and top plan, enlarged views of the indexing plates.
Figure 7:
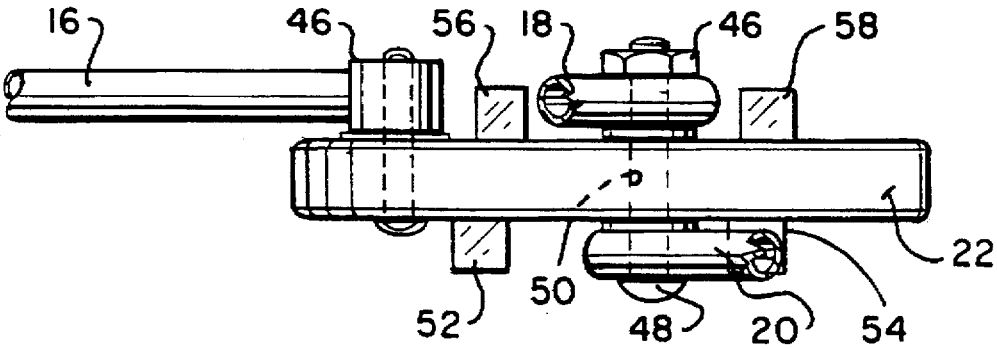

For the ensuing detailed discussion of the interconnection means of the semi-hoop elements to the plates 22 and 24, simultaneous reference is made to FIGS. 6 and 7. FIG. 6 shows a view generally parallel to the ground plane with element 16 affixed to the plate by means of a clip 46 such that element 16 extends parallel to the ground plane and actually rests thereon. The endmost portions of elements 18 and 20 each have a clip 46 secured thereto and these clips are rotatably mounted onto a pivot 48 that extends through an opening 50 in each indexing plate with the elements located on opposite sides of the plates. Paired stops 52,54 and 56,58 are secured on opposite sides of each plate providing a range of pivotal adjustment for elements 18 and 20 from the position of FIG. 3 to that of FIG. 4.

In yet a further aspect of the invention, after the apparatus has already been deployed on the ground, the extent of netting 36 normally positioned between the textile sheet 38 and strip 28 is pulled or lifted out of this sandwiched relationship and the textile sheet replaced onto the underlying strip 28 (FIG. 5). A generally U-shaped support 60 has its arms extending through grommets or eyelets 61 affixed to the sides of strip 28 adjacent end 34 and fixedly forced into the ground plane. Then, the netting 36 is drawn back over the support 60 and extended until it rests on the element 20 (FIG. 5). In this manner, the entire body can be selectively provided with a proportional amount of sun exposure, or the head and shoulders fully protected while the lower part of the body is only partially exposed to the rays of the sun.

At the completion of use, the netting 36 is replaced between the textile sheet 38 and strip 28, the support 60 is placed through the entrance opening 42 in the enclosure 44, the composite strip-textile sheet-netting is then rolled about the second base 34 toward the first base 26 and placed within the enclosure 44. With both elements 18 and 20 moved to the back limit stops, the entire assemblage is in a bag form that can be readily carried by a single individual with the aid of strap 14.

In practical constructions of the invention, one apparatus having a height of 19 inches weighed approximately 4.5 pounds. With a larger sunshade apparatus having a height of 29 inches, the overall weight was about 6 pounds.

Figure 9:
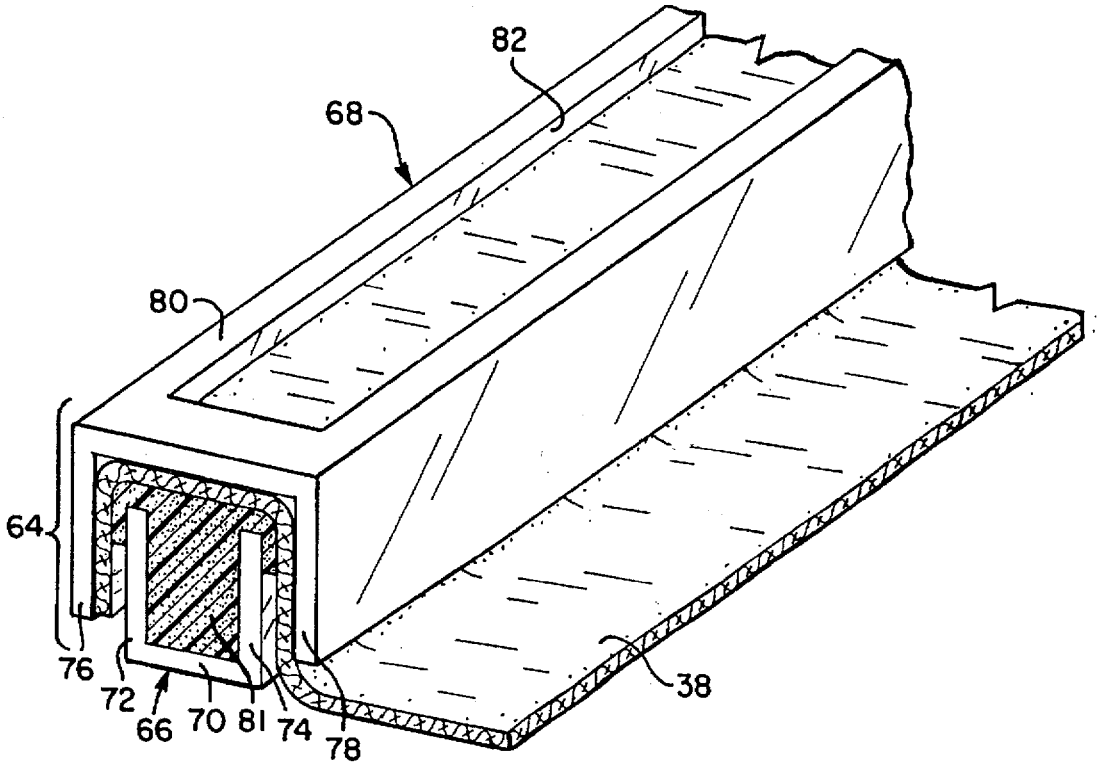
FIG. 9 is a perspective view of an alternative form of mounting base.

Turning now to FIG. 9, there is shown an alternative form of mounting base 64 for use with the invention. As shown, the mounting base has a lower rail 66 secured to the material strip 28 and an upper rail 68 releasably clamped to the lower rail for frictionally enaging an end portion of the toweling 38 therebetween. More particularly, the lower rail 66 consists of a rigid member (e.g., plastic) of generally U-shaped construction having a cross-wall 70 secured to the strip 28 and a pair of upstanding sidewalls 72 and 74. Similarly, the upper rail 68 is a generally U-shaped member, the sidewalls 76 and 78 of which are spaced apart sufficiently so as to enable fitting receipt about the outer surfaces of the lower rail sidewalls 72 and 74 and spaced slightly therefrom. The upper rail cross-wall 80 includes a generally elongated opening 82 for a use to be described later.

On assembly of the mounting base 64, first a length 81 of a pliable plastic foam material is located within the space between the sidewalls 72 and 74 of the lower rail 66 with parts of the foam material extending over the outer ends of 72 and 74. Next, the end portion of the toweling 38 is laid onto the plastic foam over the outer ends of sidewalls 72 and 74. Finally, the upper rail 68 is clamped over the toweling end portion and onto the lower rail as showy. When so assembled, it has been found that underlying foam pushes the toweling material upwardly into the opening 82 which enhances securement of the toweling to the mounting base 64. By use of the described base 64, the toweling 38 may be readily removed for washing or replacement as desired.

Figure 10:
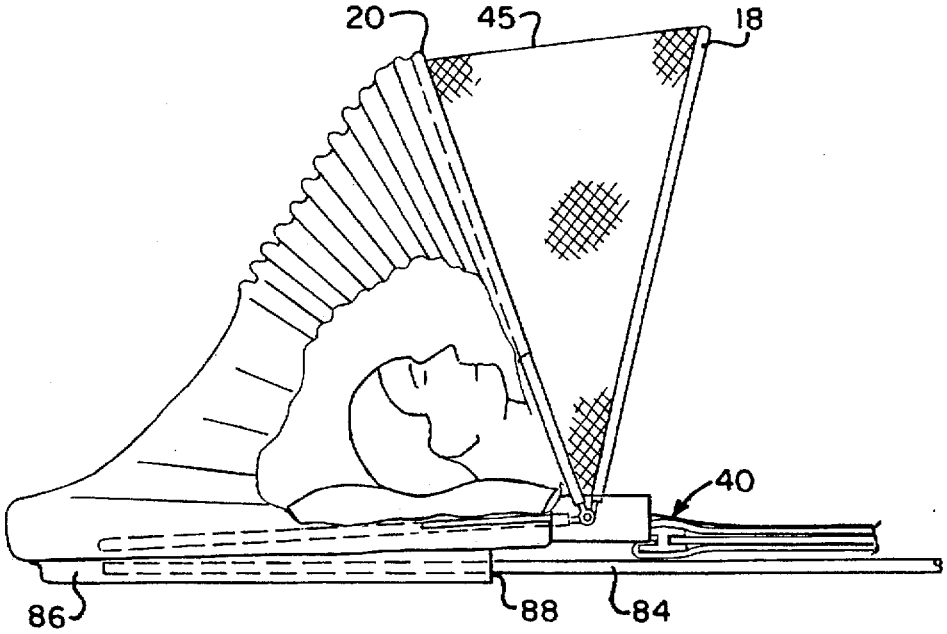
FIG. 10 is a side elevational, partially fragmentary view of a still further embodiment of the invention for use with a chaise-longue.

FIG. 10 depicts yet another version of the invention which is especially advantageous for mounting to and using the invention in connection with a so-called chaise-longue, the upper tubular part 84 of which is partially shown. Specifically, an additional piece of material 86 is secured to what was the ground-facing side of strip 28 at the end where the semi-hoop elements 16–20 are located. An opening 88 is left between strip 28 and material piece 86 permitting sliding receipt of the chaise-longue tubular part 84 into the pocket formed between the strip and material piece. Use is as shown and previously described. After use, the sunshade apparatus may be readily removed from the chaise-longue and stored or transported elsewhere, as desired.

Although the present invention has been described in connection with a preferred embodiment, it is to be understood that those skilled in the appertaining art may suggest modifications that come within the spirit of the invention as described and within the ambit of the appended claims.

What is claimed is:

1. Portable sunshade apparatus for ground-based deployment, comprising:

a first strip of a flexible material that is generally impermeable to water having first and second ends and a pair of opposite lateral edges;

a mounting base fixedly secured to the material strip inwardly of the strip first end and extending transversely of the strip lateral edges, said mounting base having first and second opposite ends;

a second strip of a flexible material permitting a portion of incident light to pass therethrough secured to the first strip second end and extending back over the first strip;

a length of a soft-to-the-touch material secured to the mounting base and extending over the second strip and underlying first strip;

first and second indexing plate means affixed respectively to the mounting base opposite ends;

a first element having two ends fixedly secured to the respective indexing plates and extending over the first strip adjacent the first strip first end;

second and third elements each having two opposite ends which are respectively pivotally connected to the indexing plate means, said second and third elements being so constructed that they can be selectively pivotally moved past each other from a first position where the second element is closer to the first mounting base to a second position where the third element is closer to the first mounting base;

means for interconnecting the first strip first end to the third element while said first strip slidingly contacting the second element; and an extent of flexible material that will allow a predetermined portion of incident light to pass therethrough interconnecting the second and third elements.

2. Portable sunshade apparatus as in claim 1, in which there is further provided a generally U-shaped mounting frame means having two side arm ends for inserting retention in a ground base adjacent the first strip second end for supporting the second strip after said strip is withdrawn from between the first strip and the length of soft-to-the-touch material.

3. Portable sunshade apparatus as in claim 2, in which first and second grommet means affixed to the first strip opposite lateral edges receive the side arm ends therethrough.

4. Portable sunshade apparatus as in claim 1, in which each indexing plate means includes an opening, a pivot extending through the plate means opening, and clip means on each end of the second and third elements which are pivotally received on the pivot.

5. Portable sunshade apparatus as in claim 4, in which each indexing plate means includes a generally flat base having first and second stop means on each major surface thereof for limiting the pivoting of said second and third elements.

6. Portable sunshade apparatus as in claim 1, in which each element is constructed of a springlike rod having its ends secured to the indexing plate means so that the rod intermediate portion extends away from the first mounting base in a generally arcuate loop, the loop of the second element being smaller than the loop of the third element enabling the second element to pass through the loop of the third frame element on pivoting movement.

7. Portable sunshade apparatus as in claim 1, in which the opposed first strip lateral edges on the same side between the mounting base and first strip first end are secured together.

8. Portable sunshade apparatus as in claim 1, in which first and second extents of air permeable material interconnect the respective first strip oppoosite lateral edges.

9. Portable sunshade apparats as in claim 1, in which the first strip is constructed of a material which is light and moisture and air impermeable.

10. Portable sunshade apparatus as in claim 1, in which the second strip is constructed of a netting material enabling approximately 50% of incident sunlight to pass therethrough.

11. Portable sunshade apparatus as in claim 1, in which there is further provided a piece of material edge secured to the outwardly facing surface of the first strip leaving an unsecured extent for receiving the tubular arms of a chaise-longue therethrough to support said sunshade apparatus.

12. Portable sunshade apparatus as in claim 1, in which the mounting base includes first and second generally C-shaped rails which clampingly fit together on the soft-to-the-touch material.

13. Portable sunshade apparatus as in claim 12, in which one of the C-shaped rails includes an opening in a cross-wall, and the other C-shaped rail includes a quantity of pliable plastic foam which moves the soft-to-the-touch material into the opening in the one rail on clamping fitting to said material.

* * * * *